United States Patent [19]

Bucher

[11] 3,970,244

[45] July 20, 1976

[54] CLEARING CENTRIFUGE

[75] Inventor: Albert Bucher, Kriens, Switzerland

[73] Assignee: Escher Wyss Limited, Zurich, Switzerland

[22] Filed: June 10, 1974

[21] Appl. No.: 477,970

[30] Foreign Application Priority Data

June 19, 1973 Switzerland ..... 8860/73

[52] U.S. Cl. ..... 233/22; 210/380 R; 239/587; 127/19

[51] Int. Cl.[2] ..... B04B 11/02

[58] Field of Search ..... 233/1 R, 16, 21, 22, 233/27, 28, 46; 239/562, 587; 210/380, 382; 127/19

[56] References Cited

UNITED STATES PATENTS

| | | | |
|---|---|---|---|
| 710,843 | 10/1902 | Cone | 239/562 |
| 1,926,402 | 9/1933 | Pearce | 210/380 X |
| 3,599,877 | 8/1971 | Goldschmied | 239/562 |
| 3,837,913 | 9/1974 | Hillebrand | 210/380 X |

FOREIGN PATENTS OR APPLICATIONS

| | | | |
|---|---|---|---|
| 644,555 | 5/1937 | Germany | 233/22 |
| 421,825 | 4/1967 | Switzerland | 233/22 |

*Primary Examiner*—George H. Krizmanich
*Attorney, Agent, or Firm*—Robert A. Ostmann

[57] ABSTRACT

Clearing centrifuge having an inlet tube for filling the centrifuge drum; said inlet tube extending into said drum and comprising at least two outlet apertures for the material to be centrifuged; the improvement that said inlet tube comprises two or more tube parts which are arranged at least partly in one another and are adapted to be adjusted relatively to one another, and that two of said tube parts each comprise, or jointly form, one of said outlet apertures.

12 Claims, 5 Drawing Figures

Fig.2
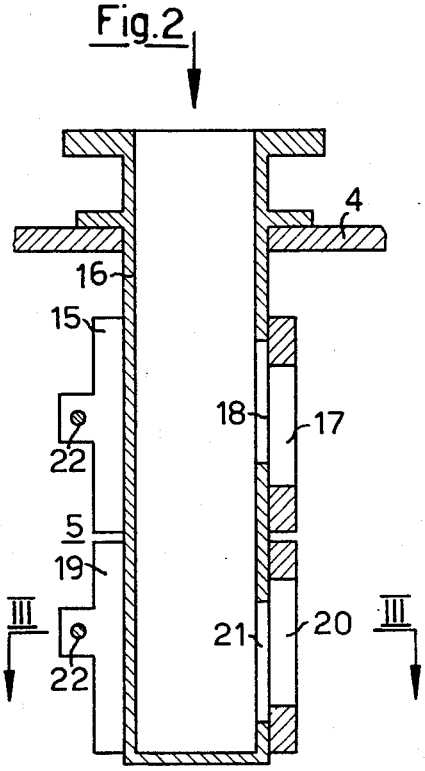
Fig.4
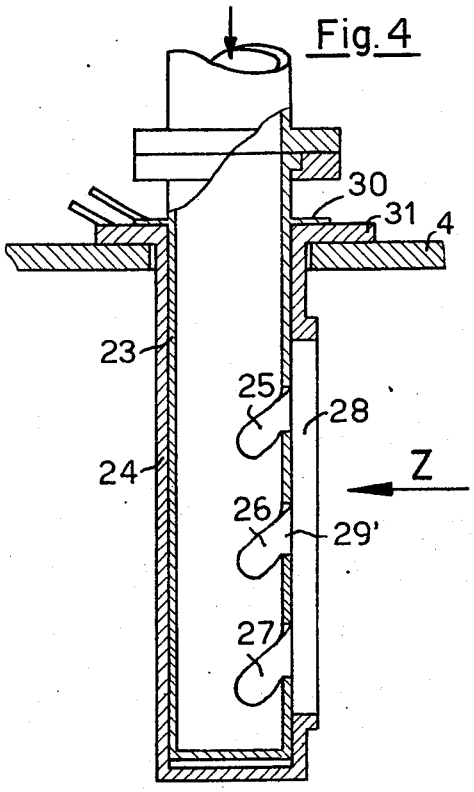
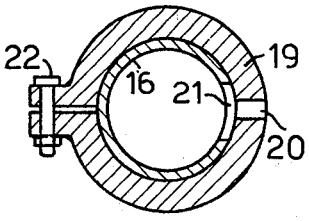
Fig.3
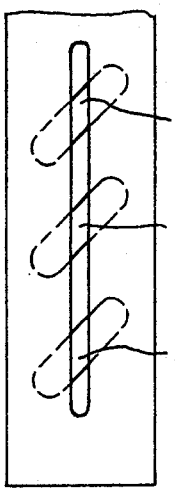
Fig.5

CLEARING CENTRIFUGE

BACKGROUND OF THE INVENTION

The invention concerns a clearing centrifuge with an inlet tube for filling the centrifuge drum with material to be centrifuged, the said inlet tube extending substantially parallel to the centrifuge axis, being mounted in the cover of the centrifuge housing, extending into the centrifuge drum, and comprising therein an outlet aperture for the said material, the said aperture being directed radially relatively to the centrifuge axis.

In known clearing centrifuges, that is in peeling or shelling centrifuges with vertical centrifuge axis, the inlet tube comprises a pivotable tube which is vertically adjustable, and whose outlet is directed radially with respect to the centrifuge axis and tangentially with respect to the centrifuge drum. Even though the inlet tube is adjustable, in the case of materials which have poor inflow properties it is not possible to achieve with such a tube a uniform distribution of the material in question, that is to say it is not possible to obtain a uniform bed height over the entire width of the centrifuge drum.

In another peeling centrifuge the inlet tube comprises for the material to be centrifuged an outlet aperture which is sub-divided by intermediate walls and extends substantially over the entire width of the drum. In this case, various constructions of inlet tube are required depending on the material being centrifuged, and these have to be interchanged with one another.

SUMMARY OF THE INVENTION

The invention has as its object to provide a clearing centrifuge which has an inlet tube which can be adapted to many different kinds of material to be centrifuged and makes it possible to obtain a bed of material of uniform height over the entire width of the centrifuge drum.

In a clearing centrifuge of the kind initially described, this object is achieved according to the invention in that the inlet tube comprises two or more tube parts which are at least partly arranged in one another, which are sealed relatively to one another and are adjustable relatively to one another, and that two of these tube parts have or form an outlet aperture for the outflow of the said material from the inlet tube.

Advantageously the tube parts are capable of displacement relatively to one another in the axial direction of the tube and/or adapted to rotate relatively to one another about the axis of a tube part.

In a particularly advantageous constructional form of the inlet tube, two tube parts form between themselves a space through which the material to be centrifuged can flow, the outlet apertures are situated in the vicinity of that end of the tube parts which is remote from the cover of the centrifuge housing, and the tube part of smaller diameter projects from the tube part of larger diameter, and the sealing device sealing these tube parts relatively to one another is situated at the mentioned end of the larger-diameter tube part.

Another advantageous form of the inlet tube consists in that a tube part of larger diameter is completely fitted over a tube part of smaller diameter and comprises one of the outlet apertures, and in the smaller-diameter tube part there is provided within the region of the larger-diameter tube part a throughflow aperture for the throughflow of the material to be centrifuged out of the smaller-diameter tube part into the larger-diameter tube part.

It is also advantageous if such tube parts are guided to fit in one another and a throughflow aperture of the smaller-diameter tube part and a throughflow aperture of the larger-diameter tube part are elongated and arranged at an angle relatively to one another so that by turning the tube parts with respect to one another the outlet aperture formed at the intersection of the two throughflow apertures for the material to be centrifuged can be displaced in the axial direction of the inlet tube.

BRIEF DESCRIPTION OF THE DRAWING

Constructional examples of the subject of the invention are shown in simplified manner in the drawings by means of which the invention is explained in more detail. In the drawing:

FIG. 2 shows an axial section through another inlet tube, FIG. 3 shows a cross-section on the line III—III of FIG. 2, FIG. 4 shows an axial section through a further inlet tube and FIG. 5 shows a view in the direction of the arrow Z in FIG. 4.

DESCRIPTION OF THE PREFERRED EMBODIMENTS

Figure 1:
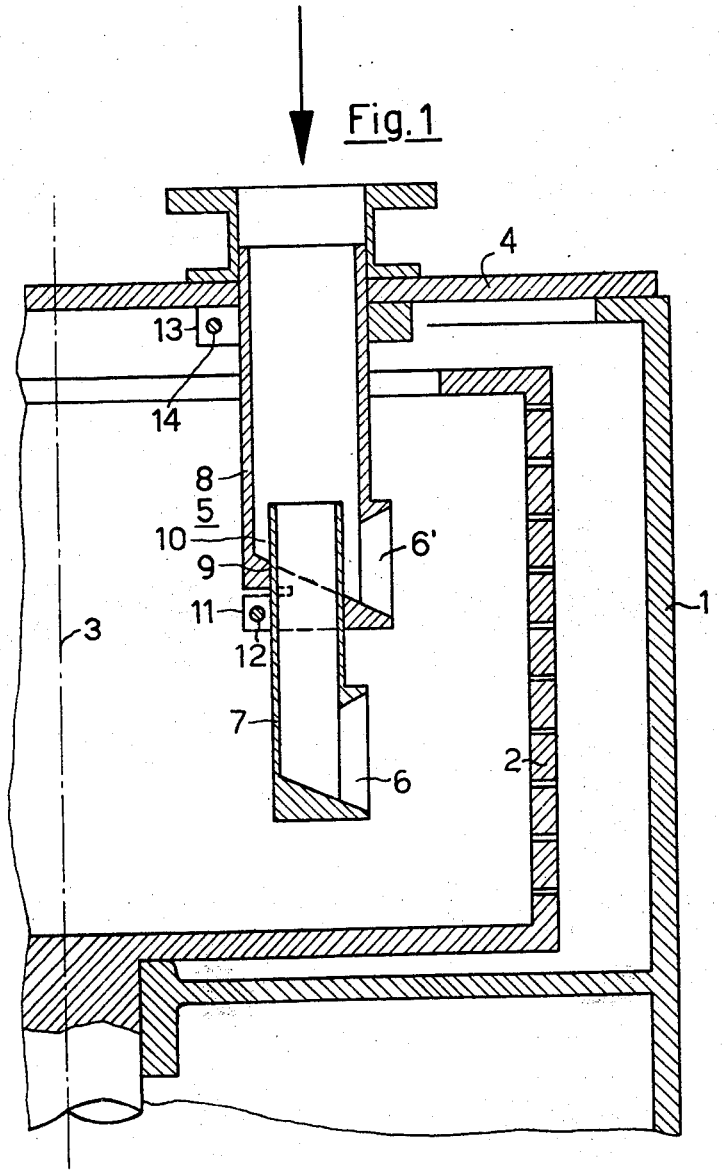
FIG. 1 shows part of an axial section through a centrifuge with the inlet tube according to the invention.

In the constructional example shown in FIG. 1 there is mounted in a centrifuge housing 1 a centrifuge drum 2 which is adapted to rotate about an axis 3. Mounted in a cover 4 of the centrifuge housing 1 is an inlet tube 5 which extends parallel to the centrifuge axis 3, extends into the centrifuge drum 2 and comprises there an outlet aperture 6 for the material to be centrifuged, said aperture being directed radially with respect to the centrifuge axis 3.

The inlet tube 5 comprises two tube parts 7 and 8 which are partly arranged in one another, are sealed relatively to one another at a sealing region 9 and are adapted to be adjusted relatively to one another. One tube part 7 which is of smaller diameter has the outlet aperture 6 which is directed radially with respect to the centrifuge axis 3 and the other tube part 8 has a further outlet aperture 6' which is radial with respect to the centrifuge axis 3, the apertures 6 and 6' being provided for the outflow of the said material from the inlet tube 5.

The tube parts 7 and 8 are adapted to be displaced relatively to one another in the axial direction of the inlet tube and adapted to be rotated relatively to one another about the axis of a tube part, which in this case coincides with the axis of the inlet tube.

Likewise, the tube part 8 is adapted to be displaced relatively to the cover 4 in the axial direction of the inlet tube and to be rotated about the axis of the tube part 8.

The two tube parts 7 and 8 form between themselves a space 10 through which the material to be centrifuged can flow. The outlet apertures 6 and 6' are situated in the vicinity of that end of the respective tube part which is remote from the cover 4 of the centrifuge housing 1. The smaller-diameter tube part 7 projects from the larger-diameter tube part 8 and the region 9 where the tube parts are sealed relatively to one another is situated at the mentioned end of the larger-diameter tube part 8.

To secure the tube part 7 relatively to the tube part 8, the end of the tube part 8 which is remote from the cover 4 is constructed as a clamping ring 11 which can be clamped by means of a clamping screw 12. To secure the tube part 8 relatively to the cover 4 there is secured on the cover 4 a clamping ring 13 which can be clamped by a clamping screw 14.

In this way the two outlet apertures 6 and 6' can be displaced relatively to one another and also relatively to the centrifuge drum 2 in the direction of the centrifuge axis 3. Also the two outlet apertures 6 and 6' can be turned relatively to one another and relatively to the shell of the centrifuge drum 2 about the axis of the inlet tube 5. Thus the inlet can be adapted to any quality of material to be centrifuged, so that a uniform height of material over the width of the centrifuge drum 2 can be achieved for any quality of material.

In the constructional example shown in FIG. 2 and FIG. 3 a tube part 15 of larger diameter is fitted completely over a tube part 16 of smaller diameter and comprises one of the outlet apertures, namely an outlet aperture 17. In the smaller-diameter tube part 16 there is provided within the region of the tube part 15 a throughflow aperture 18 for the throughflow of the material from the tube part 16 into the tube part 15. Likewise a further tube part 19 of larger-diameter is fitted over the tube part 16 of smaller-diameter and comprises the other outlet aperture, namely an outlet aperture 20. In the tube part 16 there is provided in the region of the tube part 19 a throughflow aperture 21 for the throughflow of the material from the tube part 16 into the tube part 19.

The tube parts 15 and 19 themselves are constructed as clamping rings which can be secured by the tightening of clamping screws 22 relatively to the tube part 16. The tube part 16 is mounted securely in the cover 4.

The outlet apertures 17 and 20 and the throughflow apertures 18 and 21 are so adapted to one another in width, length and position, that the outlet apertures 17 and 20 can be displaced in the axial direction of the inlet tube 5 and also about the axis of the inlet tube 5 to make said material flow in correctly.

In the constructional example shown in FIG. 4 and FIG. 5 two tube parts 23 and 24 are guided in one another with a fit. Throughflow apertures 25, 26 and 27 of the smaller-diameter tube part 23 and a throughflow aperture 28 of the larger-diameter tube part 24 are elongated and arranged at an angle relatively to one another. By turning the tube parts 23 and 24 relatively to one another the outlet aperture 29 or 29' or 29'' formed at the intersection of the two throughflow apertures can be displaced in the axial direction of the inlet tube.

The two tube parts 23 and 24 are mounted so that they can be rotated about their own axis but are secured in the cover 4 of the centrifuge housing in the axial direction. The two tube parts 23 and 24 project through the cover 4 and comprise a flange 30 or 31 situated on the external side of the cover 4. By turning the flange 30 relatively to the flange 31 the outlet aperture 29 can be displaced in the axial direction of the inlet tube. By turning the flange 31 relatively to the cover 4 the direction of the outlet apertures 29, 29', 29'' can be modified, relatively to the shell of the centrifuge drum 2.

As FIG. 5 shows more particularly, one of the intersecting elongated throughflow apertures, namely the throughflow apertures 25 or 26 or 27 is arranged at an inclination relatively to the axial direction of its tube part 23.

I claim:

1. In a clearing centrifuge comprising a housing having a cover at one end, a centrifuge drum mounted for rotation in the housing, and an inlet tube for filling said drum with a material to be centrifuged; and wherein the inlet tube is mounted in said cover, extends into the drum in a direction parallel with the axis of drum rotation, and includes at least two outlet apertures which are directed radially with respect to said axis and deliver said material into the drum; the improvement that said inlet tube comprises two tubular part means which are formed to provide said outlet apertures and one of which is mounted at least partly within the other, the two tubular part means including means which seals the joint between them and being adjustable in at least one direction relatively to each other to permit changes in the orientation of at least one outlet aperture with respect to the drum.

2. A centrifuge as defined in claim 1 in which the tubular part means are mounted for rotational adjustment relatively to each other.

3. A centrifuge as defined in claim 1 in which the tubular part means are mounted for longitudinal adjustment relatively to each other.

4. A centrifuge as defined in claim 1 in which the tubular part means are mounted for both longitudinal and rotational adjustment relatively to each other.

5. A centrifuge as defined in claim 4 in which the first tubular part means is mounted on the cover for both rotational and longitudinal adjustment; and the second tubular part means is mounted on the first such means for both rotational and longitudinal adjustment.

6. A centrifuge as defined in claim 5 in which the first tubular part means is supported at one of its ends by the cover, and the second tubular part means is received in and projects from the free end of the first tubular part means; each tubular part means is formed with an outlet aperture adjacent its free end; and the two tubular part means define a space within the first tubular part means through which said material to be centrifuged can pass to said outlet aperture in the first tubular part means.

7. A centrifuge as defined in claim 1 in which the second tubular part means is coaxial with and surrounds the first tubular part means; and the outlet apertures are defined by overlapping portions of cooperating openings in the first and second tubular part means.

8. A centrifuge as defined in claim 7 in which the second tubular part means comprises separate, axially adjacent sleeves which surround the first tubular part means, and each sleeve has a cooperating opening which defines an outlet aperture.

9. A centrifuge as defined in claim 7 in which the second tubular part means is a one-piece sleeve which surrounds the first tubular part means.

10. A centrifuge as defined in claim 7 in which each outlet aperture is defined by overlapping portions of elongated openings in the two tubular part means which extend at an angle to each other and at least one of which extends at an angle to the common axis of the tubular part means.

11. A centrifuge as defined in claim 10 in which at least one of said elongated openings which defines each outlet aperture is inclined with respect to said common axis; and both tubular part means are mounted for rotational adjustment about said common axis and are fixed against displacement in the direction of the common axis.

12. A centrifuge as defined in claim 1 which includes means outside the cover for adjusting at least one of the tubular part means.

* * * * *